US007878100B2

(12) United States Patent
Osterloh

(10) Patent No.: US 7,878,100 B2
(45) Date of Patent: Feb. 1, 2011

(54) METHOD FOR REMOVING TOXIC MATERIAL FROM TOXIC WEAPON PROJECTILES

(75) Inventor: James Osterloh, W. Richland, WA (US)

(73) Assignee: Parsons Corporation, Pasadena, CA (US)

( * ) Notice: Subject to any disclaimer, the term of this patent is extended or adjusted under 35 U.S.C. 154(b) by 15 days.

(21) Appl. No.: 12/419,108

(22) Filed: Apr. 6, 2009

(65) Prior Publication Data

US 2009/0241762 A1 Oct. 1, 2009

Related U.S. Application Data

(60) Division of application No. 11/330,732, filed on Jan. 11, 2006, now Pat. No. 7,631,588, which is a continuation of application No. 10/763,434, filed on Jan. 21, 2004, now abandoned.

(51) Int. Cl.
*A62D 3/20* (2007.01)
*F42B 33/00* (2006.01)

(52) U.S. Cl. ..... 86/50; 588/401; 588/403; 588/900

(58) Field of Classification Search ..... 86/50, 86/49; 588/200, 202, 203, 299, 401, 403, 588/900

See application file for complete search history.

(56) References Cited

U.S. PATENT DOCUMENTS 1,492,905 A 5/1924 Swanick
1,492,922 A 5/1924 Knight
1,492,925 A 5/1924 Knight
1,516,343 A 11/1924 Knight
3,993,221 A 11/1976 Boynton et al.
4,166,481 A 9/1979 Farris et al.
4,407,341 A 10/1983 Feldt et al.
4,690,180 A 9/1987 Gold (Continued)

FOREIGN PATENT DOCUMENTS

EP 0622605 2/2004

(Continued)

OTHER PUBLICATIONS

Examination Report of European Patent Office dated Sep. 17, 2007.

(Continued)

*Primary Examiner*—Stanley Silverman
*Assistant Examiner*—James A Fiorito
(74) *Attorney, Agent, or Firm*—Denton L. Anderson; Sheldon Mak & Anderson PC

(57) ABSTRACT

An apparatus useful in the removal of toxic materials from toxic weapon projectiles has a base, a projectile retaining container and a ram. The projectile retaining container has a projectile retainer opening, a ram opening and a drain opening. The projectile retaining container is adapted to retain a toxic weapon projectile in the projectile retainer opening. The ram is adapted to extend into a toxic weapon projectile disposed within the projectile retaining container to crush the projectile's burster well and to thereby release toxic materials to the drain opening in the projectile retaining container. The ram alternatively includes high pressure water nozzles for breaking up any coagulant particles and for thoroughly rinsing the interior side walls of the toxic weapon projectile.

8 Claims, 9 Drawing Sheets

U.S. PATENT DOCUMENTS

| | | | |
|---|---|---|---|
| 4,760,783 | A | 8/1988 | Torita et al. |
| 5,025,730 | A | 6/1991 | Petrovich |
| RE33,799 | E | 1/1992 | Gold et al. |
| 5,383,498 | A | 1/1995 | Mattern et al. |
| 5,427,157 | A | 6/1995 | Nickens et al. |
| 5,463,887 | A | 11/1995 | Vasseur |
| 5,626,042 | A | 5/1997 | Vasseur |
| 5,737,709 | A | 4/1998 | Getty et al. |
| 5,781,868 | A | 7/1998 | Miller et al. |
| 5,974,937 | A | 11/1999 | Doughty et al. |
| 6,245,958 | B1 | 6/2001 | Morse et al. |
| 6,320,092 | B1 | 11/2001 | Vinnikov et al. |
| 6,393,900 | B1 | 5/2002 | Buckner, III et al. |
| 6,470,783 | B2 | 10/2002 | Ito et al. |
| 6,805,844 | B1 | 10/2004 | Holt |
| 6,901,835 | B1 | 6/2005 | Chamlee |

FOREIGN PATENT DOCUMENTS

| | | |
|---|---|---|
| FR | 1464807 | 3/1967 |
| JP | 2001066100 | 3/2001 |
| JP | 2002195800 | 7/2002 |
| JP | 2003075099 | 3/2003 |
| JP | 2003075100 | 3/2003 |
| JP | 2003314998 | 11/2003 |
| WO | WO9534797 | 12/1995 |

OTHER PUBLICATIONS

International Search Report in International Application No. PCT/US2004/037260, mailed Nov. 9, 2005.

Full English translation of JP 2001-066100, published Mar. 2001.

Full English translation of JP 2002-195800, published Jul. 2002.

Full English translation of JP 2003-075099, published Mar. 2003.

Full English translation of JP 2003-075100, published Mar. 2003.

Full English translation of JP 2003-314998, published Nov. 2003.

Publication entitled "Assembled Chemical Weapons Assessment," Final Technical Report, Prepared for Program Manager for Assembled Chemical Weapons as Assessment, dated Jun. 8, 2001.

Derwent Abstract Accession No. 2001-295354 (for JP 2001-066100 cited above).

Derwent Abstract Accession No. 2001-685526 (for JP 2002-195800 cited above).

Derwent Abstract Accession No. 2003-452228 (for JP 2003-075099 cited above).

Derwent Abstract Accession No. 2003-452229 (for JP 2003-075100 cited above).

Derwent Abstract Accession No. 2003-452228 (for JP 2003-848950 cited above).

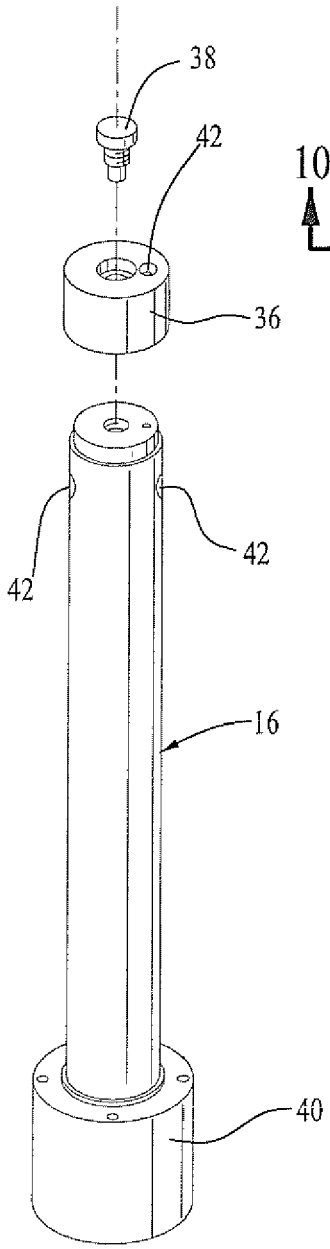
FIG. 7
FIG. 9
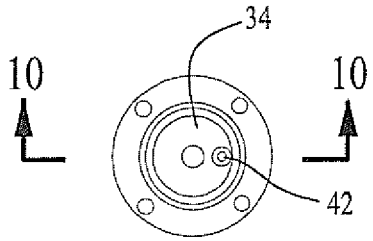
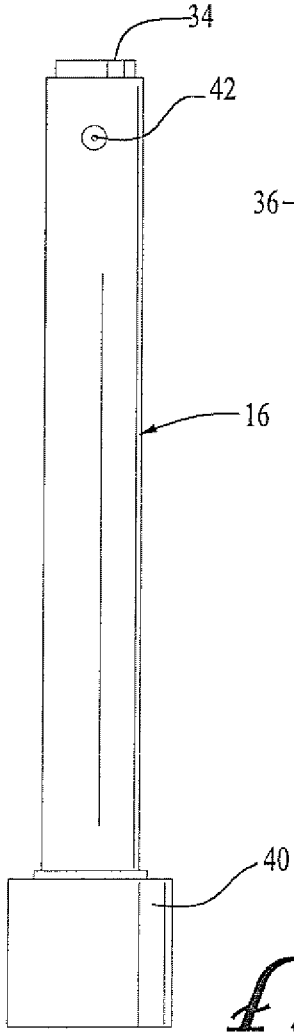
FIG. 8
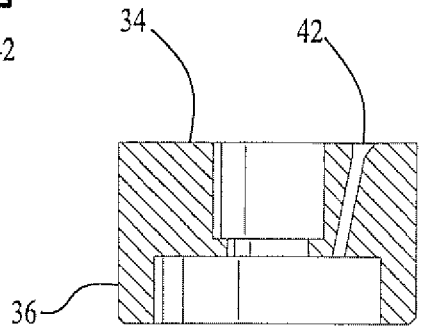
FIG. 10

METHOD FOR REMOVING TOXIC MATERIAL FROM TOXIC WEAPON PROJECTILES

RELATED APPLICATIONS

This application is a divisional application of U.S. patent application Ser. No. 11/330,732, filed Jan. 11, 2006 now U.S. Pat. No. 7,631,588, entitled Apparatus for Removing Toxic Material from Toxic Weapon Projectiles which is a continuation of abandoned application Ser. No. 10/763,434 filed on Jan. 21, 2004, now abandoned the entirety of which is incorporated herein by reference.

BACKGROUND OF THE INVENTION

The removal of toxic materials from toxic weapon projectiles, such as chemical weapon projectiles, is a major problem for all nations having aging toxic weapons. Typically, the toxic materials within such projectiles are extremely lethal and cannot be dealt with except under extremely secured conditions.

Many of the toxic materials used in toxic chemical weapon projectiles are liquid in form. For such projectiles, prior methods for removing the toxic material from the projectiles generally entail disposing a suction tube into the toxic agent cavity of the projectiles and vacuuming out the toxic material from the cavity. The problems with such methods are severalfold. First of all, the methods are of no use where some or all of the toxic materials are non-liquid in form. This is a considerable problem because many of the liquid toxic materials tend to coagulate with age and form large solid masses within the toxic agent cavity. Secondly, such prior art methods do nothing towards removing the considerable amount of toxic materials which continue to adhere to the interior walls of the projectile.

Accordingly, there is a need for an apparatus for removing toxic materials from toxic weapon projectiles which avoids these problems in the prior art in a simple, inexpensive and efficient manner.

SUMMARY

The invention satisfies this need. The invention is an apparatus useful in the removal of toxic material from a toxic weapon projectile having a casing, a burster well, a base and an ogive. The apparatus comprises a) a base, b) a projectile retaining container disposed on the base for accepting and retaining the ogive of a toxic weapon projectile, the projectile retaining container having a projectile retainer opening, a ram opening and a drain opening, c) a ram disposed on the base and extending upwards through the ram opening into the projectile retaining container, the ram including a ram head having one or more spray nozzles, the ram being extendible and retractable between (1) a retracted ram position wherein the ram is disposed proximate to the ram opening, and (2) an extended ram position wherein the ram is disposed distal to the ram opening; d) a projectile retainer opening seal for sealing the ogive of a toxic weapon projectile within the projectile retaining opening; and e) a ram opening seal for sealing the ram within the ram opening.

DRAWINGS

These features, aspects and advantages of the present invention will become better understood with regard to the following description, appended claims and accompanying figures where:

FIG. 7 is a perspective, exploded view of the ram useable in the apparatus illustrated in FIGS. 2-5;

FIG. 8 is a side view of the ram useable in the apparatus illustrated in FIGS. 2-5;

FIG. 9 is a plan view of the ram illustrated in FIG. 8;

FIG. 10 is a cross-sectional side view of the ram illustrated in FIG. 9, taken along lines 10-10;

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 1:
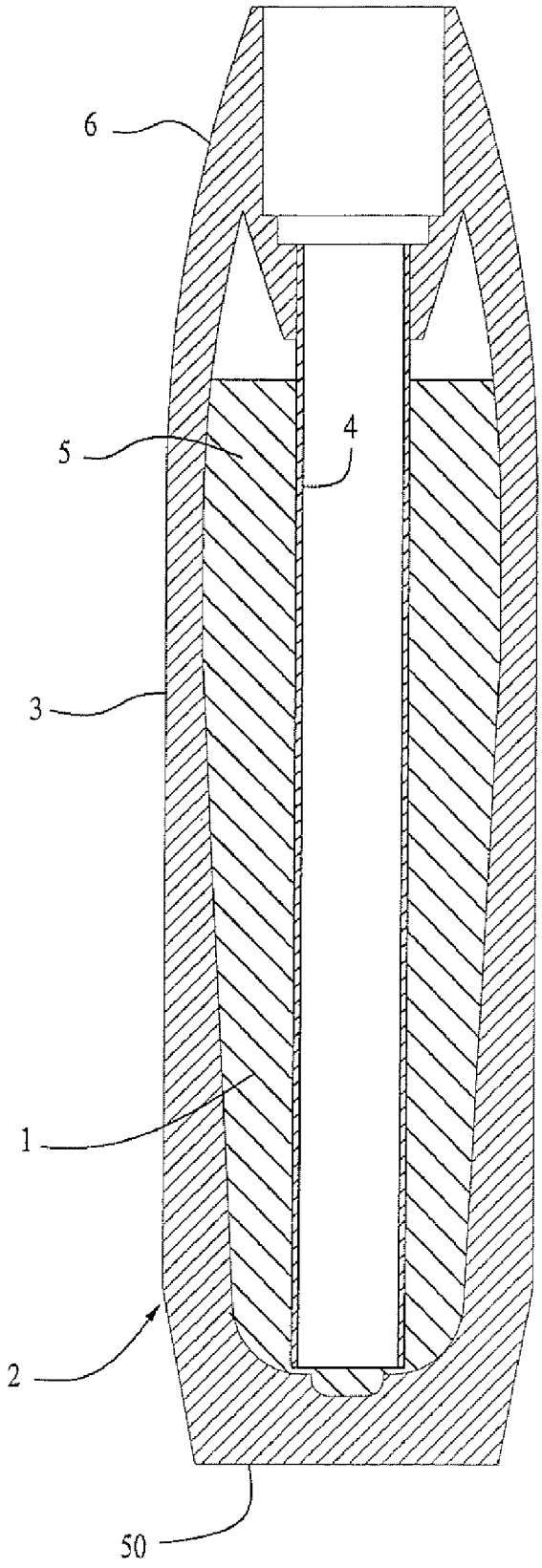
FIG. 1 is a cross-sectional view of a typical toxic weapon projectile useable in the apparatus of the invention.

The invention is directed to the removal of toxic materials 1 from a toxic weapon projectile 2 such as illustrated in FIG. 1. A typical toxic weapon projectile 2 has a steel outer casing 3 and a centrally disposed burster well 4. The burster well 4 and the outer steel casing 3 cooperate together to define and seal off a toxic agent cavity 5. When the projectile 2 is ready to be detoxified, the projectile's conical fuse has been removed from the ogive 6 of the projectile 2 and all explosive material has been removed from the burster well 4. The removal of the projectile's conical fuse leaves a central opening 7 in the ogive 6.

The invention is a unique apparatus 10 and a method for using the apparatus 10. The apparatus 10 comprises a base 12, a projectile retaining container 14 and a ram 16.

The base 12 can be of any suitable size and shape capable of retaining a toxic weapon projectile 2, the projectile retaining container 14 and the ram 16 during operation. Typically, the base 12 is made with steel structural components.

The projectile retaining container 14 is disposed on the base 12 and is adapted for accepting and retaining the ogive 6 of a toxic weapon projectile 2. The projectile retaining container 14 defines a projectile retainer opening 18, a ram opening 20 and a drain opening 22. The projectile retaining container 14 is best understood by reference to FIG. 6.

The projectile retaining container 14 also includes a projectile retainer opening seal 24 for sealing the ogive 6 of a toxic weapon projectile 2 within the projectile retaining opening 18. In the embodiment illustrated in the drawings, the projectile retainer opening seal 24 is provided by a liner 26 disposed within the interior of the projectile retaining container 14. The liner 26 is typically made from a fluorocarbon polymer, such as polytetrafluoroethylene, marketed by the DuPont Company of Wilmington, Del. under the Teflon® trademark. The liner 26 is retained within the projectile retaining container 14 by a liner retention ring 28. Preferably, the liner 26 is biased towards the top of the projectile retaining container 14 by springs 30 or other biasing means disposed between the liner retention ring 28 and the liner 26.

A resilient gasket 32, such as a rubber gasket, is attached to the bottom of the liner 26 to provide a primary means for preventing toxic material from upwardly escaping through the projectile retainer opening 18 along the sides of the ogive 6. Preferably, the interface between the ogive 6 and the liner 26 also forms a tortuous path to further impede the escape of toxic material from the projectile retainer opening 18.

The ram 16 is disposed on the base 12 and extends into the ram opening 20 in the projectile retaining container 14. The ram 16 is extendable and retractable between (1) a retracted ram position wherein the ram 16 is disposed proximal to the ram opening 20, and (2) an extended ram position wherein the ram 16 is disposed distal to the ram opening 20. In a typical embodiment, the travel distance between the retracted ram position and the extended ram position is between about 4⅛ inches and 6⅝ inches.

The ram 16 includes a ram head 34 which comprises a ram head cap 36 retained on the ram 16 by a ram head cap bolt 38.

The diameter of the ram 16 is chosen to closely match the diameter of the central opening 7 in the ogive 6 of the projectile 2 into which the ram 16 will be extended. For example, where the projectile 2 is a 105 mm projectile or a 155 mm projectile, the diameter of the central opening 7 in the ogive 6 is 1.845 inches. For these projectiles 2, the diameter of the ram 16 is chosen in one embodiment to be about 1.75 inches, leaving an annulus between the ram 16 and the central opening 7 in the ogive 6 of less than about 0.05 inches, for example about 0.047 inches. Choosing the diameter of the ram 16 to match the central opening 7 in the ogive 6 in this manner, effectively prevents the escape of any large coagulant particles within the toxic materials 1 from the projectile 2 along the ram 16 and into the projectile retaining container 14. This aspect of the invention is significant because it precludes the necessity for specialized downstream equipment to collect and process large coagulant particles.

The ram 16 is adapted with appropriate hydraulic equipment 40 to extend upwardly and retract downwardly. In a typical embodiment, the ram 16 is designed to deliver at least about 100 tons of force across the ram head 34. In operation, the ram 16 typically delivers between about 50 tons of force and 60 tons of force during the time the ram 16 is used to crush the burster well 4 of the projectile 2 (as described below).

Preferably, the ram 16 includes one or more spray nozzles 42 capable of accepting washing fluid at pressures in excess of 5,000 psig and dispensing such washing fluid at high velocities.

Figure 6:
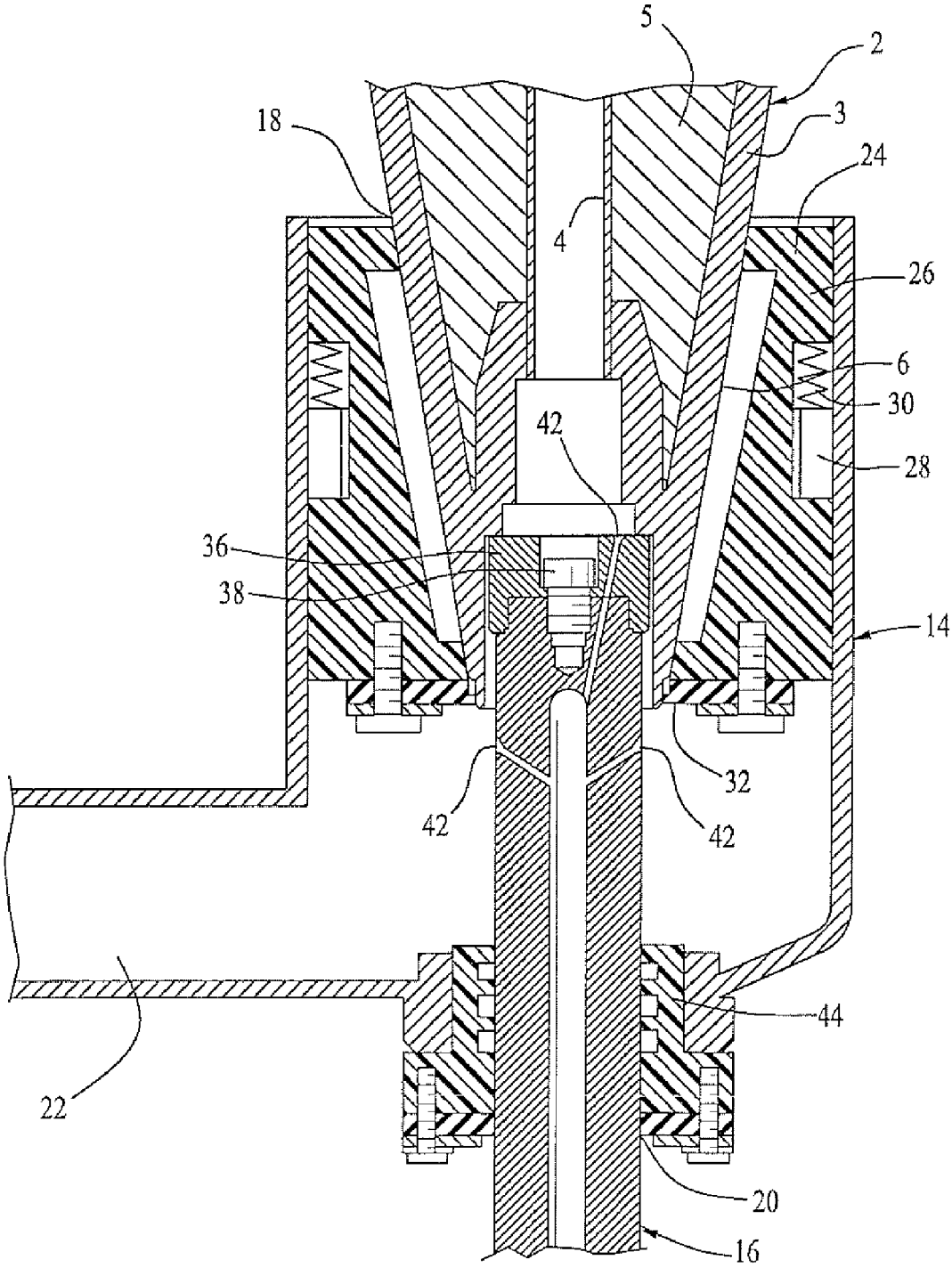
FIG. 6 is a cross-sectional diagram schematically illustrating the interior portions of the projectile retaining container used in the apparatus illustrated in FIGS. 2-5.

As can be most easily seen in FIG. 6, a ram opening seal 44 is disposed within the ram opening 20 to seal the ram 16 to the projectile retaining container 14.

Preferably, the apparatus 10 further comprises a rotator 46 for rotating a toxic weapon projectile 2 retained within the projectile retaining container 14. In the embodiment illustrated in the drawings, the rotator 46 comprises a drive wheel capable of contacting the exterior of a toxic weapon projectile 2 disposed within the apparatus 10 and rotating such projectile 2 about its longitudinal axis. The apparatus further comprises a plurality of idler wheels 47 to help retain the projectile 2 in place during its rotation.

Figure 2:
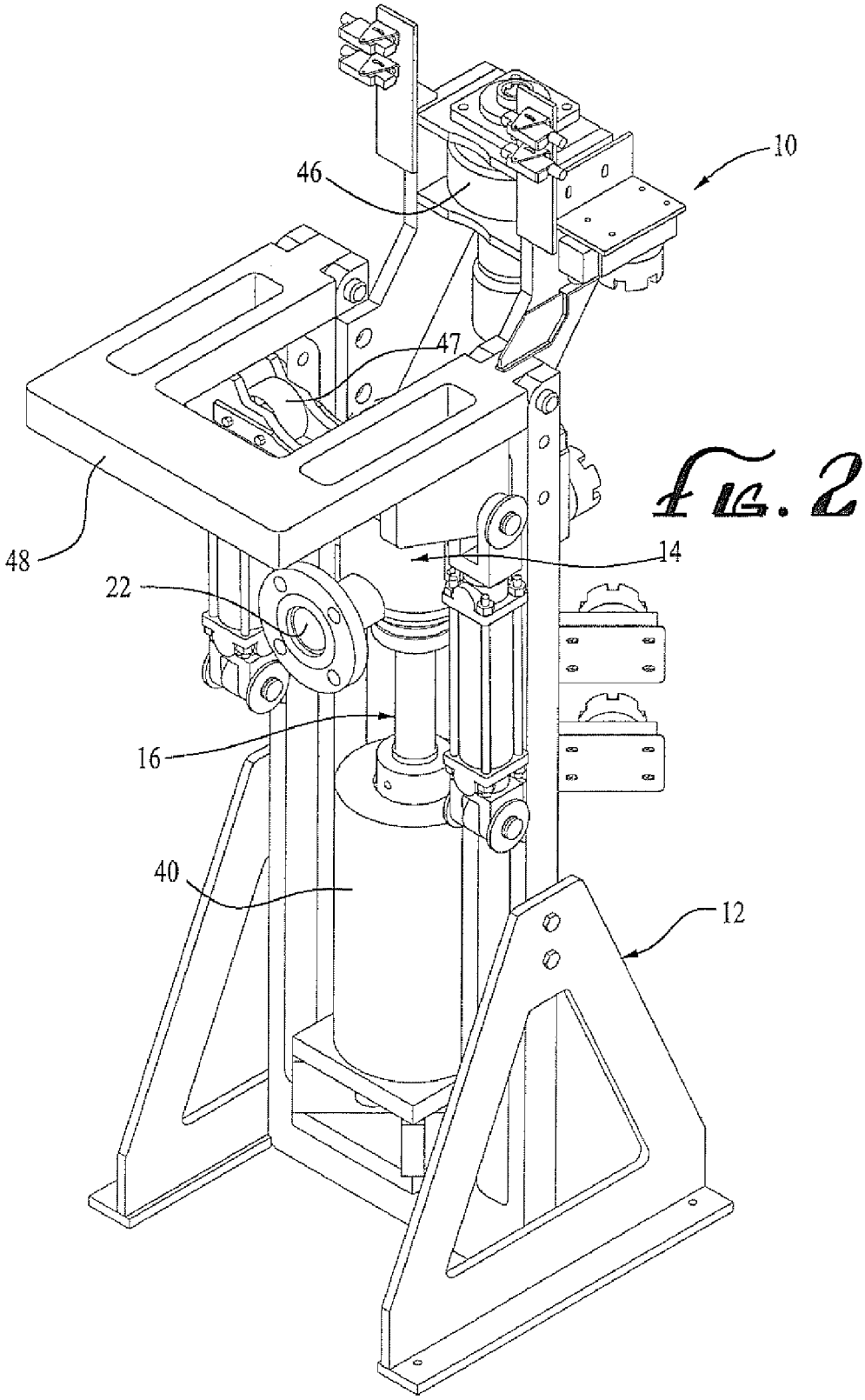
FIG. 2 is a perspective of an apparatus of the invention useful in the removal of toxic materials from toxic weapon projectiles.
Figure 3:
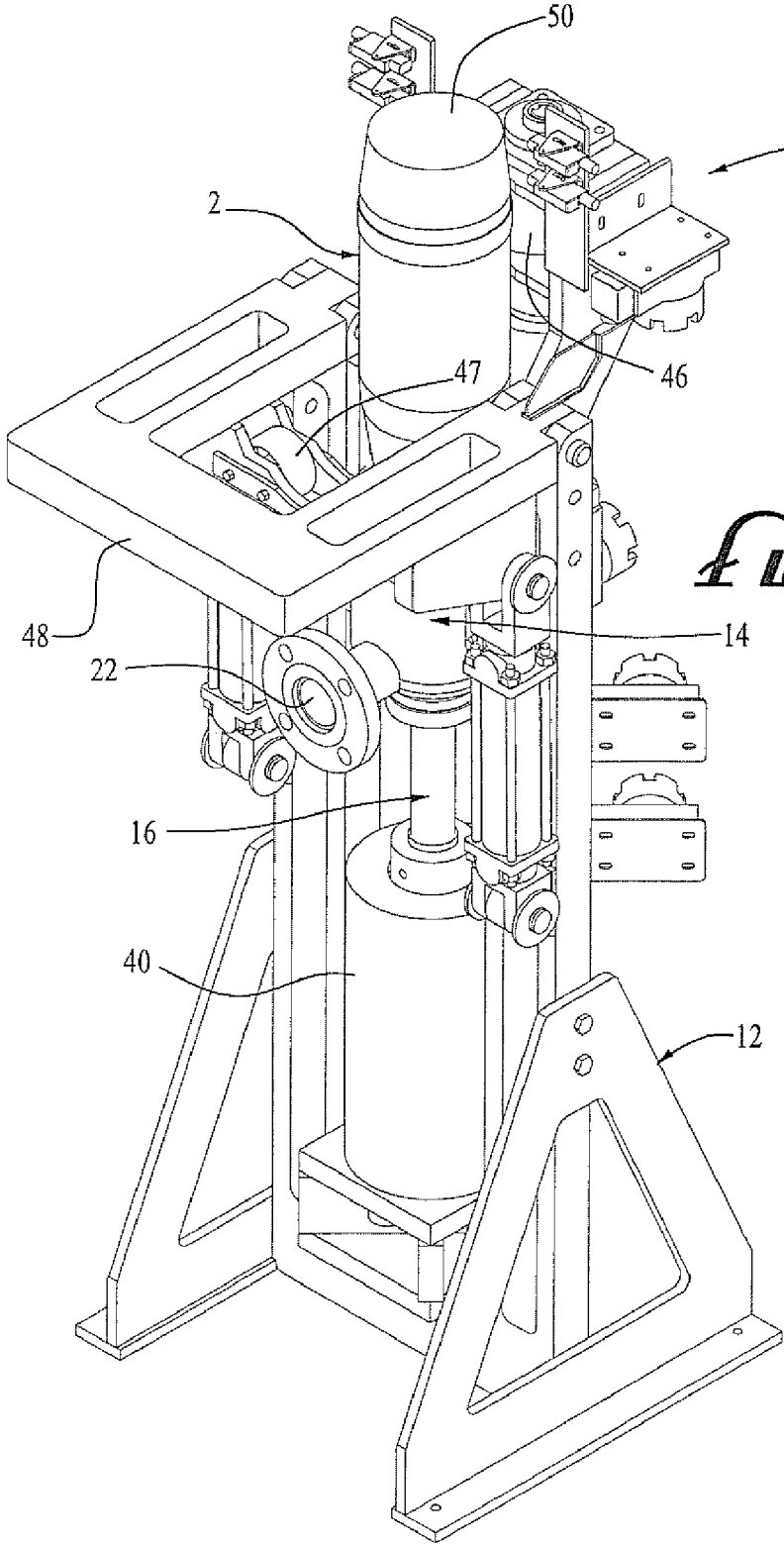
FIG. 3 is a perspective view of the apparatus illustrated in FIG. 2 showing a chemical weapon projectile initially mounted in the apparatus.
Figure 4:
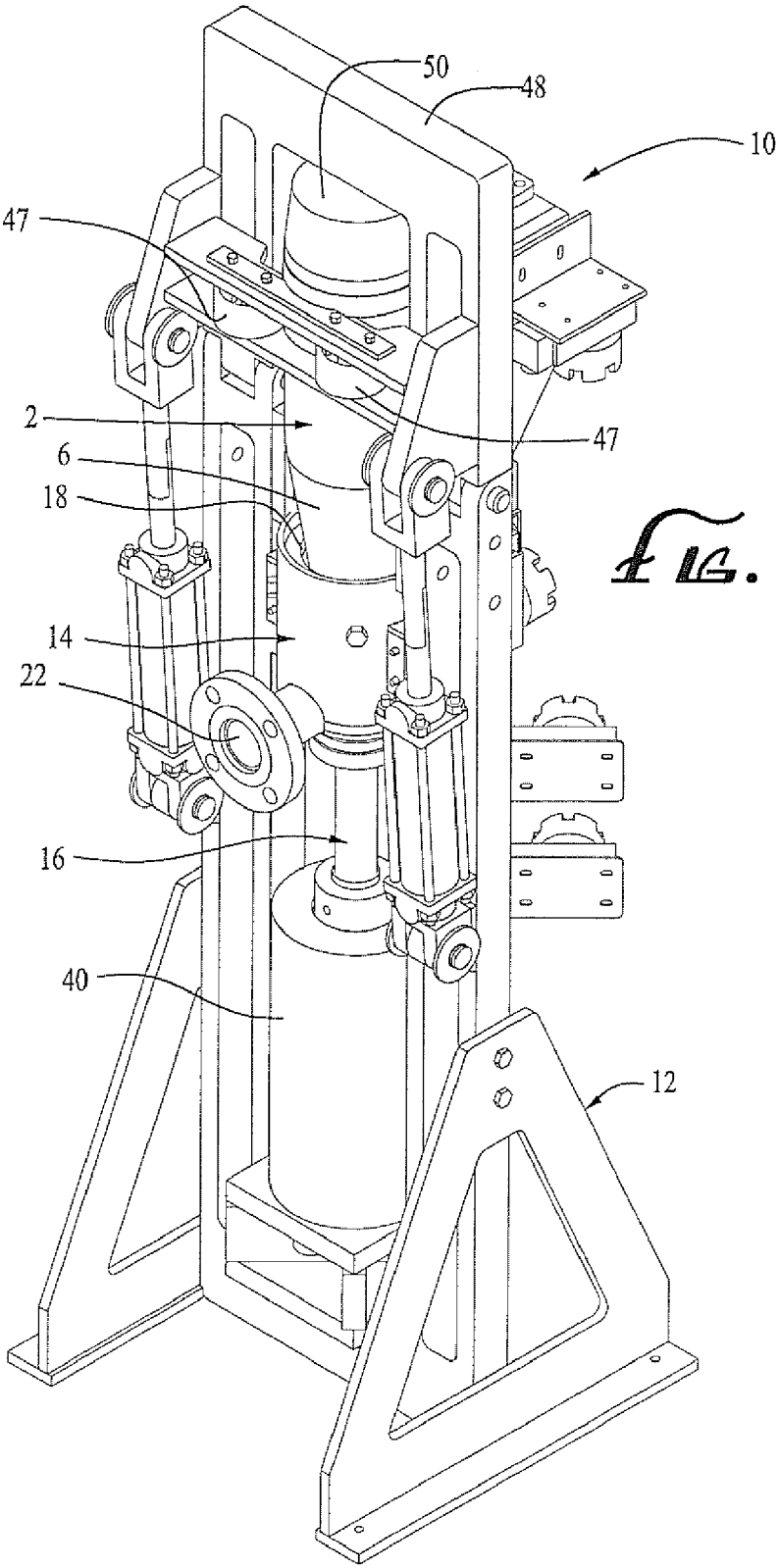
FIG. 4 is a perspective view of the apparatus illustrated in FIG. 3 shown with the projectile rigidly secured within the apparatus.
Figure 5:
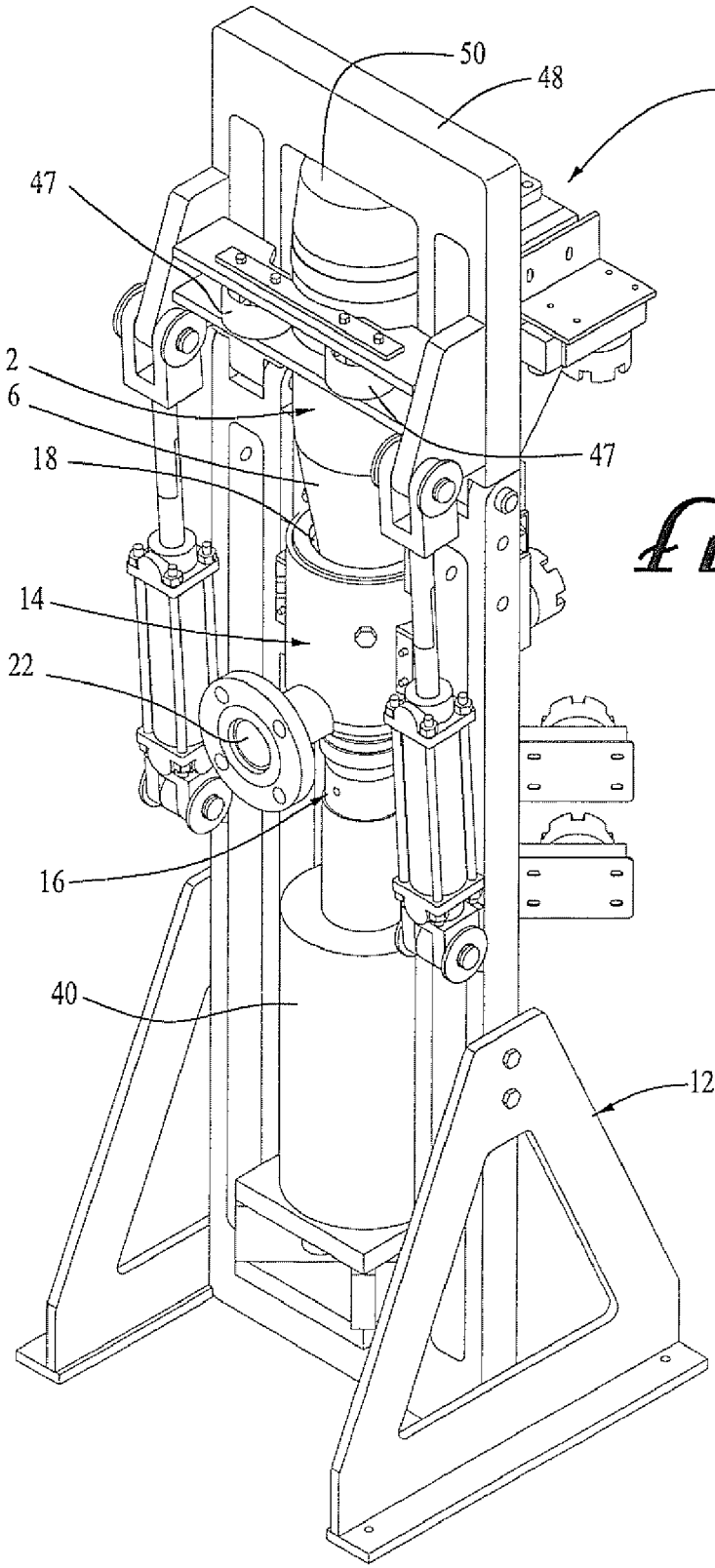
FIG. 5 is a perspective of the apparatus and projectile illustrated in FIG. 4 showing the ram portion of the apparatus fully extended into the projectile.

The apparatus 10 also preferably comprises a projectile base end retainer member 48 for rigidly retaining a toxic weapon projectile 2 within the apparatus 10. The projectile base end retainer member 48 is best seen in FIGS. 2-5. FIGS. 4 and 5 illustrate the projectile base end retainer member 48 disposed in a first retainer member position wherein the projectile base end retainer member 48 is directly above the projectile retaining container 14 so as to contact the base end 50 of the projectile 2 disposed within the projectile retaining container 14 and to rigidly retain the projectile 2 with the projectile retaining container 14. FIGS. 2 and 3 illustrate the projectile base end retainer member 48 in a second retainer member position wherein the projectile base end retainer member 48 is not disposed directly above the projectile retaining container 14, so as to facilitate the installation and uninstallation of a toxic weapon projectile 2 into and from the apparatus 10.

In operation, the projectile base end retainer member 48 is moved to the second retainer member position and a toxic weapon projectile 2, without fuse and explosive materials, is disposed downwardly into the projectile retaining container 14. The projectile base end member 48 is then moved to the first retainer member position, whereby the projectile base end retainer member 48 firmly retains the projectile 2 within the apparatus 10.

Figures 11A, 11B, 11C:
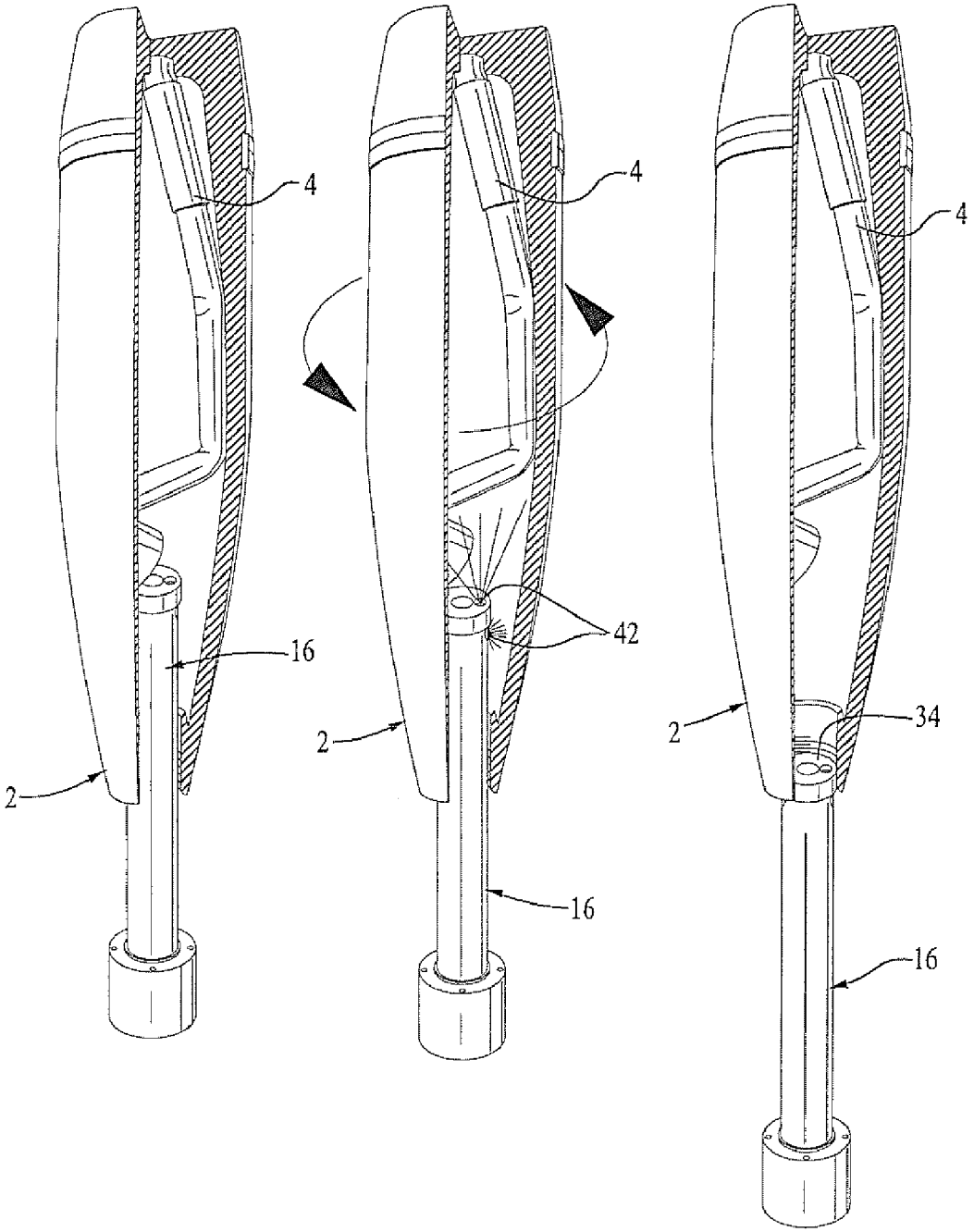
FIG. 11A is a perspective cutaway view of a projectile showing how the ram crushes the interior components of the projectile as it extends upwardly.
FIG. 11B is a perspective cutaway view of the projectile illustrated in FIG. 11A showing how the projectile is rotated while the interior of the projectile is washed with high pressure washing fluid.
FIG. 11C is a perspective cutaway view of the projectile illustrated in FIGS. 11A and 11B showing the interior of the projectile after the ram is retracted therefrom.
Figure 12:
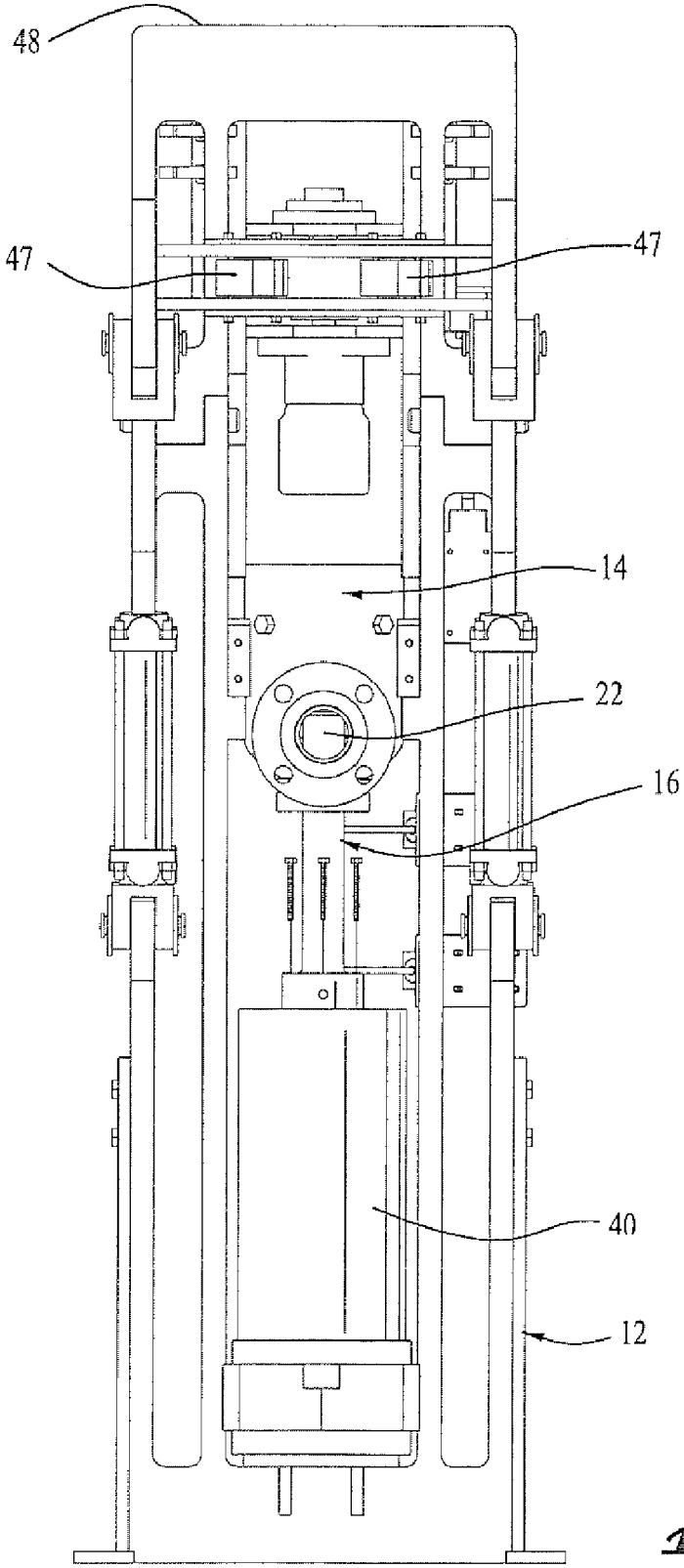
FIG. 12 is a front view of the apparatus illustrated in FIGS. 2-5.

The ram 16 is then extended from the retracted ram position towards the extended ram position. As the ram 16 extends towards the extended ram position, it pushes upwardly into the toxic weapon projectile 2. As the ram 16 pushes upwardly into the toxic weapon projectile 2, it crushes the burster well 4, as illustrated in FIGS. 11A-11C. As this occurs, the toxic material 1 within the toxic agent cavity 5 is released and gravitates downwardly out through the open lower end of the projectile 2 and into the projectile retaining container 14, from where it is removed from the projectile retaining container 14 via the drain opening 22.

After the ram 16 has crushed the burster well 4 as illustrated in FIG. 11C, it is withdrawn towards the retracted ram position a short distance of between about one quarter inch and about one inch, typically about one half inch by retracting the ram 16. By retracting the ram 16, the ram 16 tends to become disengaged from the burster well 4, allowing the projectile 2 to rotate. Thereafter, high pressure water or other suitable washing fluid is sprayed from the one or more spray nozzles 42 in the ram 16 to effectively break up most all coagulated toxic materials 1 and to thoroughly flush most remaining toxic materials 1 from the interior walls of the projectile 2. As the high pressure washing fluid is emitted from the one or more spray nozzles 42, the projectile 2 is rotated by the rotator 46 so that extreme turbulence is generated throughout the entirety of the toxic materials 1 (to break up most all coagulant particles), and so that all portions of the interior walls of the projectile 2 are thoroughly flushed with washing fluid. All of the washing fluid gravitates out of the projectile 2 and into the projectile retaining container 14 from where it is removed via the drain opening 22. Because the diameter of the ram 16 is chosen to closely match the diameter of the central opening 7 in the ogive 6, the annulus between the ram 16 and the central opening 7 is very small, so that only very small particles can escape into the projectile retaining container 14. In embodiments wherein the difference between the diameter of the ram 16 and the central opening 7 is less than about 0.1 inch, generally only particles of 0.05 inch or smaller can escape into the projectile retaining container 14.

After the projectile 2 has been flushed in the manner described above, the projectile 2 retains less than about 2% (by weight), typically less than about 0.1% (by weight), of its initial toxic material pay load. Thereafter, the projectile base end retainer member 48 is moved from the first retainer member position to the second retainer member position and the projectile 2 is removed from the apparatus 10 for further detoxification.

The invention provides a simple but reliable apparatus and method for removing most of the toxic materials from toxic weapon projectiles.

Having thus described the invention, it should be apparent that numerous structural modifications and adaptations may be resorted to without departing from the scope and fair meaning of the instant invention as set forth hereinabove.

What is claimed is:

1. A method for removing toxic material from a toxic weapon projectile having a casing, toxic material within a toxic agent cavity, a burster well, a base and an ogive, the method comprising the steps of:

(a) providing an apparatus having:

i) a base;

ii) a projectile retaining container disposed on the base for accepting and retaining the ogive of a toxic weapon projectile, the projectile retaining container having a projectile retainer opening, a ram opening and a drain opening iii) a ram disposed on the base and extending upwards through the ram opening into the projectile retaining container, the ram including a ram head having one or more spray nozzles, the ram being extendible and retractable between (1) a retracted ram position wherein the ram is disposed proximate to the ram opening, and (2) an extended ram position wherein the ram is disposed distal to the ram opening;

iv) a projectile retainer opening seal for sealing the ogive of a toxic weapon projectile within the projectile retaining opening; and v) a ram opening seal for sealing the ram within the ram opening;

(b) rigidly retaining a projectile in the apparatus with the ogive of the projectile downwardly disposed into the projectile opening in the projectile retaining container;

(c) sealing the ogive of the projectile to the projectile retaining container with the projectile retainer opening seal;

(d) extending the ram from the retracted ram position towards the extended ram position whereby the ram crushes the burster well and releases the toxic material from the toxic agent cavity;

(e) pressurizing a washing fluid through the one or more spray nozzles to flush toxic material from the projectile, whereby washing fluid and toxic material gravitates out of the projectile and into the projectile retaining container; and (f) removing washing fluid and toxic material from the projectile receiving container via the drain opening.

2. The method of claim 1 wherein the apparatus comprises a rotator for rotating a toxic weapon projectile retained within the projectile retaining container, and wherein the method further comprises the step of rotating the projectile during the flushing of toxic materials from the projectile in step (e).

3. The method of claim 2 wherein, prior to rotating the projectile in step (e), the ram is retracted towards the retracted ram position by a distance between about one quarter inch and about one inch.

4. The method of claim 1 wherein the projectile base end retainer member is moveable between (1) a first retainer member position wherein the retainer member is directly above the projectile retaining container and (2) a second retainer member position wherein the retainer member is not disposed directly above the projectile retaining container, and wherein the method comprises the further steps of moving the projectile end member to the second retainer member position prior to retaining the projectile in the apparatus in step (b), and, after the projectile is retained within the apparatus, moving the projectile base end retainer member to the first retainer member position, whereby the projectile base end retainer member rigidly retains the projectile in the apparatus.

5. The method of claim 1 wherein the projectile retainer opening seal comprises a fluorocarbon polymer liner disposed within the projectile retaining container.

6. The method of claim 1 wherein the ram is capable of delivering at least about 100 tons of force across the ram head.

7. The method of claim 1 wherein the one or more spray nozzles is capable of accepting washing fluid at pressures in excess of 5,000 psig, and wherein the step of flushing toxic materials from the projectile uses a washing fluid pressurized to in excess of 5,000 psig.

8. The method of claim 1 wherein the ogive of the projectile defines a round central ogive opening having a diameter, wherein the ram has a circular cross-section with a diameter, and wherein the difference between the diameter of the central ogive opening and the diameter of the ram is less than about 0.1 inch.

* * * * *